US005552582A

United States Patent [19]

Abe et al.

[11] Patent Number: 5,552,582

[45] Date of Patent: Sep. 3, 1996

[54] IMAGE HEATING APPARATUS

[75] Inventors: Atsuyoshi Abe; Yasumasa Ohtsuka, both of Yokohama; Yohji Tomoyuki, Ichikawa; Manabu Takano; Daizo Fukuzawa, both of Tokyo; Kenichi Ogawa, Yokohama, all of Japan

[73] Assignee: Canon Kabushiki Kaisha, Tokyo, Japan

[21] Appl. No.: 493,825

[22] Filed: Jun. 22, 1995

[30] Foreign Application Priority Data

Jun. 24, 1994 [JP] Japan ..... 6-165898

[51] Int. Cl.[6] ..... G03G 15/20

[52] U.S. Cl. ..... 219/619; 355/285; 219/216

[58] Field of Search ..... 355/285, 289; 219/216, 619, 635, 650, 656, 659, 600, 601

[56] References Cited

U.S. PATENT DOCUMENTS

| | | | |
|---|---|---|---|
| 4,570,044 | 2/1986 | Kobayashi et al. . | |
| 4,675,487 | 6/1987 | Verkasalo | 219/10.43 |
| 4,719,489 | 1/1988 | Ohkubo et al. . | |
| 4,912,514 | 3/1990 | Mizutani . | |
| 5,074,019 | 12/1991 | Link | 29/116.2 |
| 5,177,549 | 1/1993 | Ohtsuka et al. . | |
| 5,253,024 | 10/1993 | Okuda et al. . | |
| 5,293,202 | 3/1994 | Adachi et al. . | |
| 5,331,385 | 7/1994 | Ohtsuka et al. . | |
| 5,365,314 | 11/1994 | Okuda et al. . | |
| 5,444,521 | 8/1995 | Tomoyuki et al. . | |

FOREIGN PATENT DOCUMENTS

| | | |
|---|---|---|
| 0649072 | 4/1995 | European Pat. Off. . |
| 57-205766 | 12/1982 | Japan . |
| WO85/01532 | 4/1985 | WIPO . |

OTHER PUBLICATIONS

*Patent Abstracts of Japan*, vol. 6, No. 233(P156), Nov. 19, 1982 for JP 57-133466, Aug. 18, 1982.

*Patent Abstracts of Japan*, vol. 6, No. 225(P154), Nov. 10, 1982 for JP 57-128372, Aug. 9, 1982.

*Derwent World Patent Index*, Acc. No. 93-192801 for JP-A-05121157, May 18, 1993.

*Primary Examiner*—R. L. Moses

*Attorney, Agent, or Firm*—Fitzpatrick, Cella, Harper & Scinto

[57] ABSTRACT

An image heating apparatus includes magnetic flux generating means, having an excitation coil and a core member therein, for generating magnetic flux; an electroconductive member, movable together with a recording material having and image, for generating heat by eddy current generated therein by the magnetic flux generated by the magnetic flux generating means, wherein the image is heated by the heat; wherein the core member is divided into first and second portions in a direction substantially perpendicular to a movement direction of the electroconductive member.

30 Claims, 11 Drawing Sheets

IMAGE HEATING APPARATUS

FIELD OF THE INVENTION AND RELATED ART

The present invention relates to an image heating apparatus applicable to an image forming apparatus such as a copying machine, printer or the like, more particularly to an apparatus for effecting heating by electromagnetic induction as for an image fixing apparatus as an example of an image hearing apparatus, heat roller type is widely known. This system comprises as basic elements a metal fixing roller having a heater therein and an elastic pressing roller press-contacted thereto to form an image fixing nip therebetween, and a recording material is passed through the nip to fix the toner image on the recording material by heat and pressure.

However, with such a heat roller type a long period of time is required for the surface of the fixing roller reaches a fixing temperature because the heat capacity of the fixing roller is large. In order to permit quick start of the image forming operation, the temperature of the roller surface has to be maintained at a predetermined temperature even when the apparatus is not operated. Recently, therefore, a film heating type heating apparatus is put into practice which comprises a fixed heater (thermal heater), a heat resistive film which is movable and press-contacted to the heater and a pressing member for press-contacting the member to be heated to the heater through the film, thus heating the member to be heated by the heater through the film. With the film type heating apparatus, a low thermal capacity heater is usable. Therefore, as compared with the heat roller type, it is advantageous in the power saving and reduction of the waiting period (quick start). Since the quick start is possible, there is no need of effecting the pre-heating during the non-printing operation (stand-by heating), so that the overall power saving is accomplished.

However, the film heating type involves the following problems.

(1) When the use is made with a high rigidity thick film for the purpose of increasing durability and operational speed or the like, the heat conduction becomes poor, and the thermal capacity of the film increases, thus preventing the quick heating property. In other words, the thick film results in thermal resistance to impede the heat transfer from the heater to the recording material, thus deteriorating the energy saving and quick start properties.

(2) However, if the film is thin, the rigidity is insufficient with the result of necessity for the film travel control, and therefore, the apparatus becomes bulky with complicated structure.

(3) The selection of the material for the film is limited because of the necessity for the heat resistive property. Since the resin film has relatively high heat insulative property with the result of accumulation of the heat inside the film with the result of the parts inside the film required to have heat resistivity. Therefore, limited and expensive materials are to be used.

Therefore, the inventors have developed an electromagnetic induction type film heating apparatus, in which the film itself produces heat so that the film does not impede the heat transfer, thus improving the thermal efficiency, as proposed in U.S. Ser. No. 323,789.

In this system, magnetic field generating means comprising, for example, magnetic core metal and excitation coil, produces changing magnetic field using excitation circuit. A high frequency is applied to the coil to produce the magnetic field, in which an electroconductive member (induction magnetic material, magnetic field absorbing conductive material) in the form of a film is moved, so that the magnetic field is produced and extinguished repeatedly. By doing so, eddy currents are produced in the conductive layer in the film. The eddy currents is converted to thermal energy (Joule's heat) by the electric resistance of the conductive layer, so that the film closely contacted to the member to be heated produces heat. Therefore, the thermal efficiency is high.

That is, when the changing magnetic field crosses the conductive layer, the eddy currents are produced in the conductive layer of the film so as to produce a magnetic field impeding the change of the magnetic field. The eddy currents produce heat the conductive layer of the film by the surface resistance of the conductive layer of the film, and the amount of the heat is proportional to the surface resistance.

Thus, the heat is directly produced adjacent the surface of the film, and therefore, the quick heating is possible irrespective of the thermal capacity or the thermal conductivity of the base layer of the film. Additionally, the quick heating is accomplished irrespective of the thickness of the film.

Therefore, it is permitted that the rigidity and the thickness of the film base layer is increased to improve the durability and the operational speed, without deteriorating the power saving and quick start properties.

However, the prior art electromagnetic induction type heating system involves the following problems.

(1) Since the core metal around which the excitation coil is wound is integrally molded, and therefore, adjustment of the heat generation in the longitudinal direction is difficult.

(2) Therefore, when a thermoswitch, temperature fuse or another temperature detecting element is disposed in the nip (heat generating area) for the purpose of safety, the heat escapes to such temperature detecting element, and therefore, local heat shortage, improper fixing occurs at the position of the temperature detecting element in the nip.

(3) The amount of heat radiation is large at the end portions than in the central portion in the nip, and therefore, the amount of heat applied to the member to be charges is not uniform with the result of insufficient heating or insufficient fixing at the end portions, and the toner offset to the film at the central portion.

SUMMARY OF THE INVENTION

Accordingly, it is a principal object of the present invention to provide an image heating apparatus in which the heat generation distribution in a direction perpendicular to a movement detection of the conductive member is made uniform to prevent local shortage of heat.

It is another object of the present invention to provide an image heating apparatus in which the core metal around which the excitation coil is wound is adjusted.

It is a further object of the present invention to provide an image heating apparatus in which the core metal is divided into first and second portions in a direction perpendicular to the movement direction of the conductive member.

It is a further object of the present invention to provide an image heating apparatus in which the materials of the core metal are different in a first portion and a second portion in a direction perpendicular to a movement direction of a conductive member.

It is a further object of the present invention to provide an image heating apparatus in which the distances to the conductive members of the core member are different in a first portion and a second portion in a direction perpendicular to a movement direction of the conductive member.

It is a further object of the present invention to provide an image heating apparatus in which widths in the movement direction of the conductive member of the core metal are different in the first portion and the second portion in a direction perpendicular to the movement direction of the conductive member.

It is a further object of the present invention to provide an image heating apparatus wherein positions in the movement direction of the conductive member of the core member are different in the first portion and the second portion in a direction perpendicular to the movement direction of the conductive member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 17:
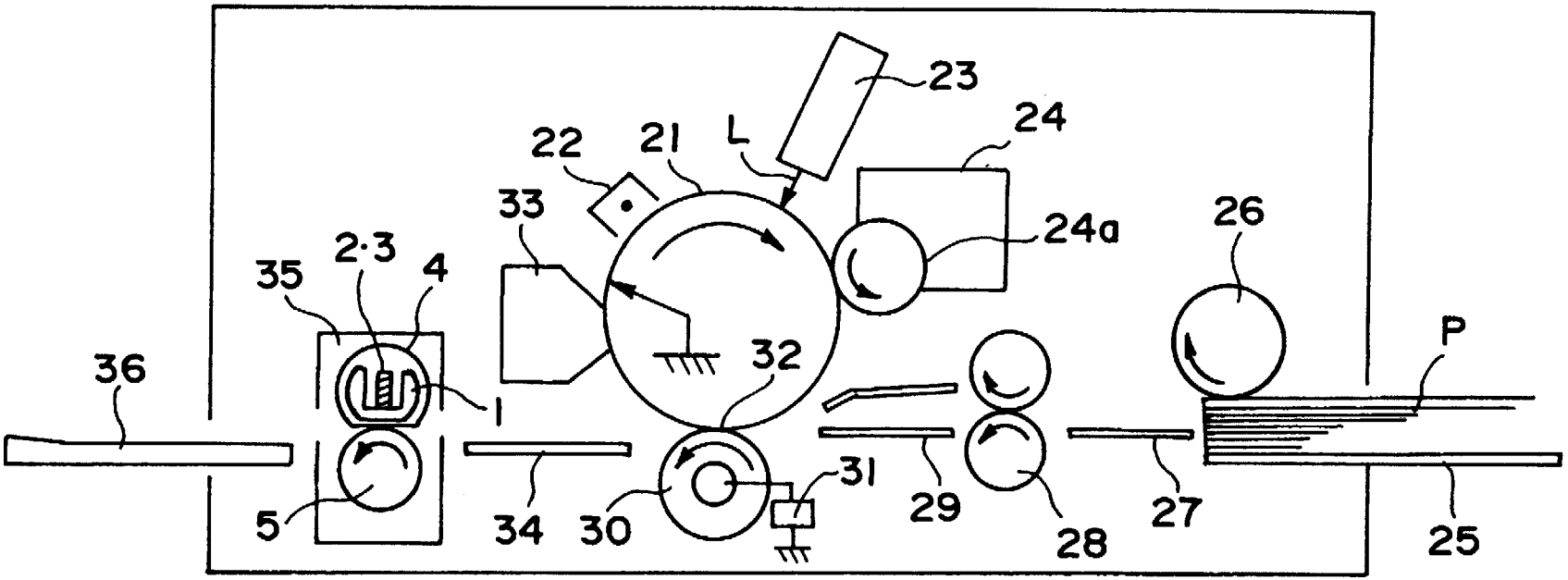
FIG. 17 illustrates an image forming apparatus.

Referring first to FIG. 17, there is shown an image forming apparatus using an image heating apparatus according to an embodiment of the present invention.

The description will first be made as to the general arrangement of the image forming apparatus in conjunction with FIG. 17.

In this embodiment, the image forming apparatus is a laser beam printer using electrophotographic process.

Designated by a reference numeral 21 is a rotatable drum type electrophotographic photosensitive member (photosensitive drum) functioning as an image bearing member (first image bearing member). The photosensitive drum 21 is driven to be rotated at a predetermined peripheral speed (process speed) in the indicated clockwise direction. During the rotation, the surface thereof is uniformly charged to a dark potential VD of a predetermined negative level by a primary charger 22.

A laser beam scanner 23 produces a laser beam L modulated in accordance with time series electric digital pixel signals indicative of intended image information supplied from a host apparatus such as an image reader (word processor, computer or the like not shown). The surface of the photosensitive drum 21 uniformly charged to the negative polarity by the primary charger 22 is exposed to the scanning laser beam, so that the absolute value of the potential reduces in the exposed area to a light potential VL, and therefore, an electrostatic latent image is formed in accordance with the intended image information on the rotating photosensitive drum 21.

Subsequently, the latent image is developed through reverse-development with toner powder charged to the negative polarity by a developing device 24 (the toner is deposited on the areas exposed to the laser beam).

The developing device 24 comprises a rotatable developing sleeve 24 on which a thin layer of the toner charged to the negative polarity is applied on the outer peripheral surface of the sleeve. The toner layer is faced to the surface of the photosensitive drum 21. The sleeve **24*a* is supplied with a developing bias voltage VDC which is smaller than the dark potential VD and larger than the light potential VL in the absolute values, and therefore, the toner is transferred from the sleeve 24*a* only to the light potential VL portion of the photosensitive drum 21**, so that the latent image is visualized (reverse developed).

On the other hand, the recording material (second image bearing member, transfer material) P stacked on a sheet feeding tray 25 is fed out by a pick up roller 26 one-by-one. It is fed to an image transfer nip portion formed between a transfer roller 30 (transfer member) supplied with a transfer bias from a voltage source 31 and a photosensitive drum 21, along a feeding guide 27, by a pair of registration rollers 28 and along a pre-transfer guide 29, at a proper timing in synchronism with the rotation of the photosensitive drum 21. Thus, the toner image is sequentially transferred from the surface of the photosensitive drum 21 onto the recording material P. The resistance of the transfer member i.e., the transfer roller 30 is preferably $10^8$–$10^9$ ohm.cm. The recording material P having passed through the transfer position 32 is separated from the surface of the photosensitive drum 21 and is introduced into an image fixing apparatus 35 (image heating apparatus) along a feeding guide 34. In the fixing apparatus 35, the transferred toner image is fixed, and, it is discharged to a discharge tray 36 as a print.

The surface of the photosensitive drum 21 after the recording material is separated therefrom, is cleaned by a cleaning device 33 so that the residual toner or the like is removed therefrom so as to be prepared for the next image forming operation.

The description will be made as to the image heating apparatus.

Embodiment 1 (FIGS. 1–5)

(1) General arrangement

Figure 1:
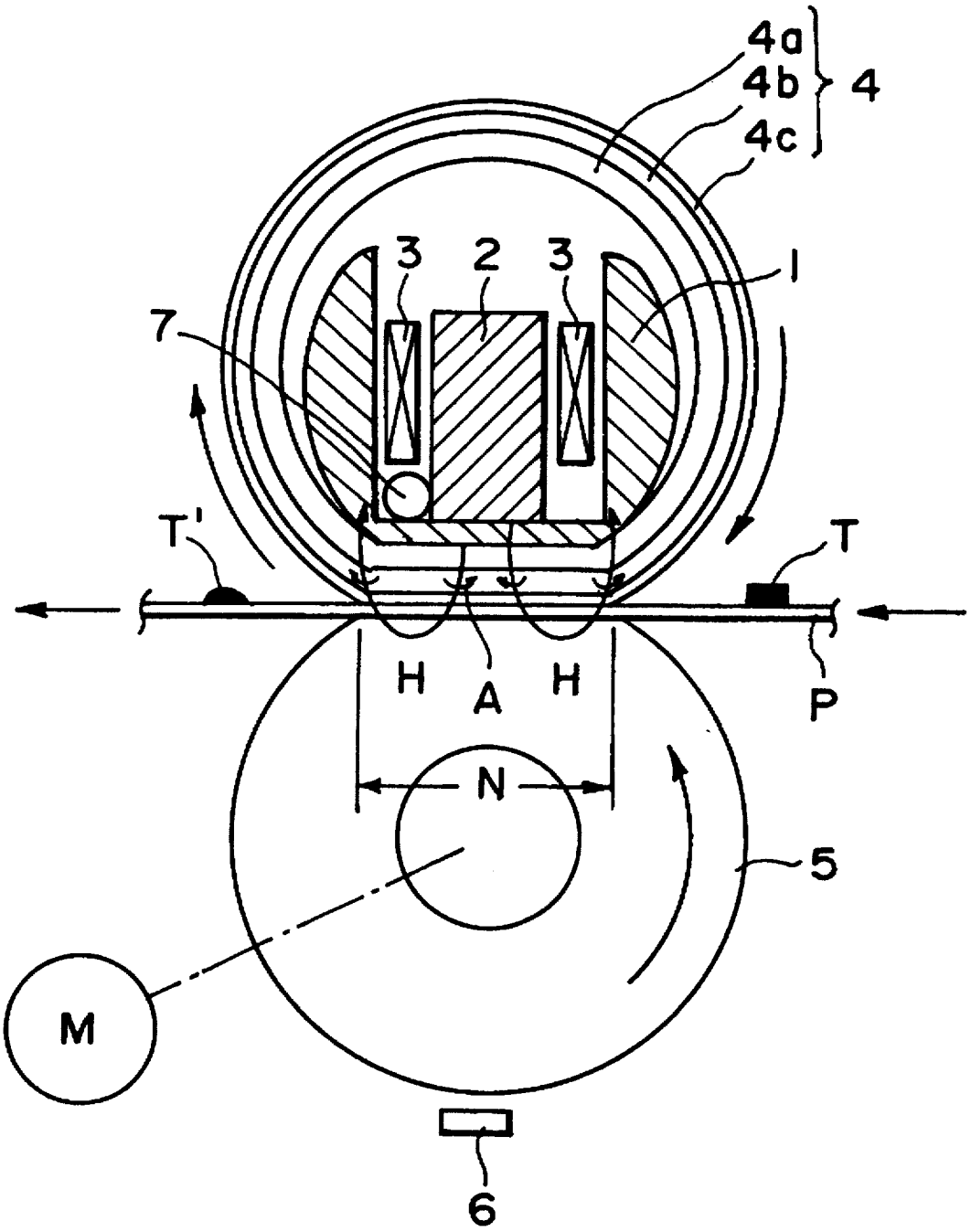
FIG. 1 is a schematic view of an apparatus according to an embodiment of the present invention.

FIG. 1 shows an image heating apparatus of an electromagnetic induction type according to Embodiment 1 of the present invention.

Designated by a reference numeral 1 is a film inside guiding stay having a substantially channel like cross-section facing upward. The stay 1 is of liquid crystal polymer, phenol resin or the like. The inside thereof accommodates an excitation coil 3 wound around a core member (iron core metal) 2 as magnetic field (magnetic flux) generating means. The stay 1 has a sliding plate bonded thereto at a portion contactable to a film 4 which will be described hereinafter.

The electromagnetic induction heating assembly constituted by the stay 1, the core metal 2 and the excitation coil 3, is an elongated member extending in a direction crossing with (perpendicular to) the movement direction of the member to be heated P or the film 4. The core metal 2 is divided into a plurality of parts which are arranged at least one direction.

Outside the assemblies 1, 2 and 3, an endless (cylindrical, seamless) heat resistive film 4 functioning as a conductive member (heating member), is loosely extended.

Designated by a reference numeral 5 is a pressing roller and comprises a core metal, and a coating of silicone rubber fluorine rubber or the like thereon. The pressing roller 5 is urged toward the bottom surface of the stay 1 with the film 4 therebetween with a predetermined pressure by an unshown bearing means and urging means.

The pressing roller 5 is rotated in the indicated counter-clockwise direction by driving means.

Rotating force is applied to the film by the friction between the film outside surface of the roller by the rotation of the pressing roller 5, so that the film 4 rotates outside the stay 1 while in contact with the bottom surface of the stay 1.

It is preferable that lubricant such as grease or oil or the like is applied between the bottom surface of the stay 1 and the inside of the film. The film 4 (conductive member) comprises a base layer **4*a* of an endless film of heat resistive resin such as polyimide, polyamide imide, PEEK, PES, PPS, PEA, PTFE, FEP or the like having a thickness of 10–100 μm, and an outside conductive layer 4*b* (at the side contactable to the member to be heated), which is iron or cobalt layer, or nickel, copper, chromium or another metal layer of 1–100 μm plated thereon. On the free side surface of the electroconductive layer 4*b*, the outermost layer (surface layer) of PFA, PTFE, FEP, silicone resin or the like having a high heat resistivity and high toner parting property (they may be mixed, or single material is usable), is provided as a parting layer 4*c*. Therefore, it is of a three layer structure. In this example, the film base 4*a* and the conductive layer 4*b* are different layers, but the film base layer 4*a*** itself may be the electroconductive layer.

The electroconductive layer **4*b* of the film produces heat by electromagnetic induction heating by the application of the electric current from an unshown excitation circuit to the excitation coil 3**.

A thermister 6 as a temperature sensing element is provided to detect the surface temperature of the pressing roller 5. The electric current applied to the excitation coil 3 is controlled on the basis of the detected temperature of the thermister 6. When the temperature of the pressing roller 5 is low, and therefore, thus thermister 6 detects low temperature, the duty ratio of the energization is increased, and on the other hand, when the detected temperature is high, the duty ratio of the energization is decreased. The thermister 6 may be disposed on the non-sliding surface of the film 1 (relative to the film) or on the core member 2.

A safety element such as temperature fuse, thermoswitch or the like 7 is provided to stop the electric energy supply to the excitation coil 3 upon occurring of overheating.

By rotating the pressing roller 5, the film 4 is rotated, by which the electric current is supplied to the excitation coil 3 from the excitation circuit. Thus, the heat is produced by the electroconductive layer **4*b* of the film 4. Then, the recording material P (member to be heated) is introduced into the nip N. The recording material is contacted to the film 4 surface, and they are passed through the nip N together with each other. By doing so, the heat of the film 4 produced by the electromagnet induction is applied to the recording material P to fix the unfixed toner image T into a fixed image T'. The recording material having passed through the nip N is separated from the surface of the film 4**.

(2) Heating principle

An AC current is supplied from an excitation circuit to the excitation coil 3, by which the electromagnetic flux is repeatedly produced and extinguished has indicated by H around the coil 3. The core 2 is so constituted that the magnetic flux H crosses the conductive layer **4*b* of the film 4**.

When the changing magnetic field crosses the conductive member, the eddy current is produced in the conductive layer such that the change of the magnetic field is prevented. The eddy current is indicated by an arrow A. Most of the eddy current flows concentratedly in the coil 3 side surface of the conductive layer **4*b* because of the surface effect, and therefore, the heat is produced in proportion to the surface resistance Rs of the film conductive layer 4*b***.

The surface resistance Rs relative to the surface depth provided by angular frequency ω, magnetic permeability μ, specific resistance ρ is:

$$\delta = \sqrt{2\rho/\omega\mu}$$

$$Rs = \rho/\delta = \sqrt{\omega\mu\rho/2}$$

The electric power P produced in the conductive layer **4*b* of the film 4**:

$$P \alpha RS - |I_f|2dS$$

$I_f$: current through the film.

Therefore, the electric energy can be increased by increasing Rs or $I_f$, so that the amount of heat generation can be increased. In order to increase Rs, the frequency ω is increased, or the use is made with a material having a high magnetic permeability μ or high specific resistance ρ.

From this, it is predicted that if non-magnetic metal is used for the conductive layer **4*b***, the heating is difficult.

However, when the thickness t of the conductive layer 4b is smaller than the surface skin depth δ, $$Rs \approx \rho/t$$

Therefore, the heating is possible.

The frequency of the AC current applied to the excitation coil 3 is preferably 10–500 kHz. If it is higher than 10 kHz, the absorption efficiency in the conductive layer 4b is increased, and an inexpensive is usable for the excitation circuit if the frequency is not less than 500 kHz.

If it is not less than 20 kHz, it is higher than audible range, and therefore, the noise is not produced during the electric energy supply, and if it is not less than 200 kHz, the loss in the excitation circuit is small, and therefore, the radiation noise to the outside is small.

When an AC current of 10–500 kHz, is applied to the conductive layer 4b, the surface (skin) depth is approx. several μm to several hundreds μm.

If the thickness of the electroconductive layer 4b is made smaller than 1 μm, very small amount of the electromagnetic energy is absorbed by the conductive layer 4b with the result of low energy efficiency.

Additional problem is that the leaked magnetic field heat the other metal part.

On the other hand, in the case of the conductive layer 4b exceeding 100 μm, the rigidity of the film 4 is too high, and the heat is conducted in the conductive layer 4b with the result of difficulty in warming the parting layer 4c.

For these reasons, the thickness of the conductive layer 4b is 1–100 μm.

In order to increase the heat generation of the conductive layer 4b, $I_f$ is increased. For this purpose, the magnetic flux produced by the coil 3 is enhanced, or the change of the magnetic flux is increased. To achieve this, the number of windings of the coil 3 is increased, or the material of the core metal 2 of the coil 3 is high magnetic permeability with low residual magnetic flux density, such as ferrite, permalloy or the like. When the resistance of the conductive layer of the film is too low, the heat generating efficiency by the eddy current is worsened, and therefore, the volume resistivity of the electroconductive layer 4b is preferably not less than $1.5\times10^{-8}$ ohm.m under 20° C.

In this embodiment, the conductive layer 4b of the film 4 is formed by plating, but it may be formed by vacuum evapolation, sputtering or the like. By doing so, the conductive layer 4b may be made of aluminum Or metal oxide alloy which can not be formed by plating. However, the plating is convenient for obtaining sufficient film thickness, and therefore, the plating process is preferable when 2–200 μm layer thickness is desired.

For example, if the use is made with the ferromagnetic material such as iron, cobalt, nickel or the like of high magnetic permeability, the electromagnetic energy produced by the excitation coil 3 is easily absorbed, so that the heating efficiency is improved, and in addition, the magnetic energy leaking outside is decreased so that the influence to the external device is reduced. Among these materials of high resistivity is further preferable.

The conductive layer of the film 4 is not limited to a metal, but may be provided by dispersing electroconductive, high magnetic permeability particles of whiskers in a bonding material for bonding the surface parting layer to a low thermal conductivity and electroconductive base material.

For example, the conductive layer may be provided by dispersing in a bonding material a mixture of electroconductive particles such as carbon or the like and particles of manganese, titanium, chromium, iron, copper, cobalt, nickel or the like or particles or whiskers of ferrite (alloy of the above materials) or oxide thereof.

As described in the foregoing, since the heat is directly generated by the neighborhood of the surface layer of the film 4, and therefore, the rapid heating is possible Without influence of the thermal conductivity or thermal capacity of the film base layer 4a.

Additionally, since the heating is not dependent on the thickness of the film 4, the quick temperature rise to the fixing temperature is possible even if the base material 4a is thickened for the purpose of improving the rigidity of the film in order to increase the operational speed.

Since the base member 4a is of low thermal conductivity resin material, the heat insulative property is high, so that the thermal isolation is provided from large thermal capacity member such as coil or the like inside the film, and therefore, the heat loss is low, and the energy efficiency is high, even if continuous printing is carried out. Additionally, the heat does not transmit to the coil 3, and the performance of the coil is not deteriorated.

The temperature rise in the apparatus is suppressed, corresponding to the improve of the thermal efficiency, and therefore, when the heating apparatus is used in an image heating fixing device in an electrophotographic apparatus or another image forming apparatus, the influence to the image forming station is reduced.

Figure 2:
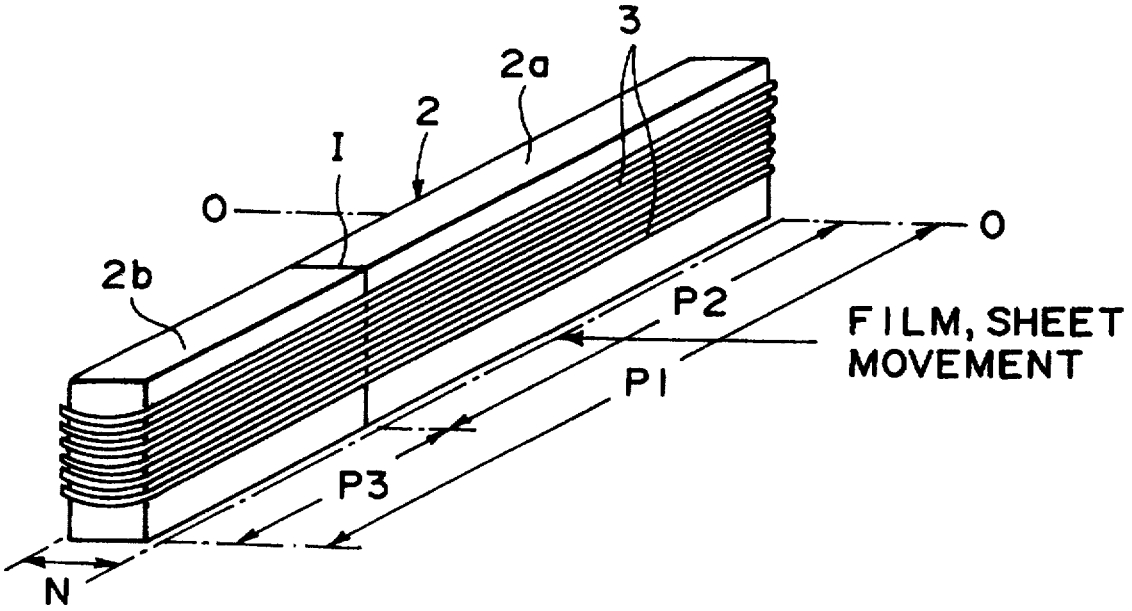
FIG. 2 is a schematic perspective view of a magnetic coil as magnetic field generating means.
Figure 3:
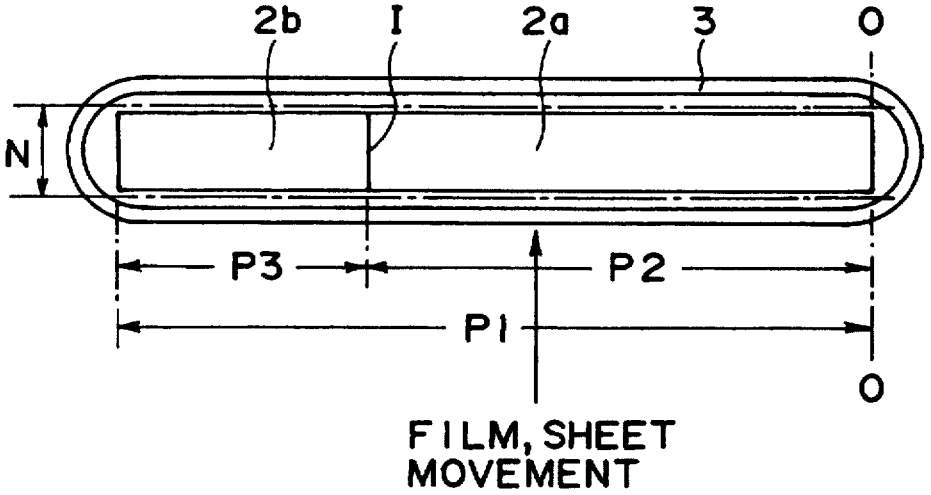
FIG. 3 is a schematic top plan view of the elements shown in FIG. 2.
Figure 4A:
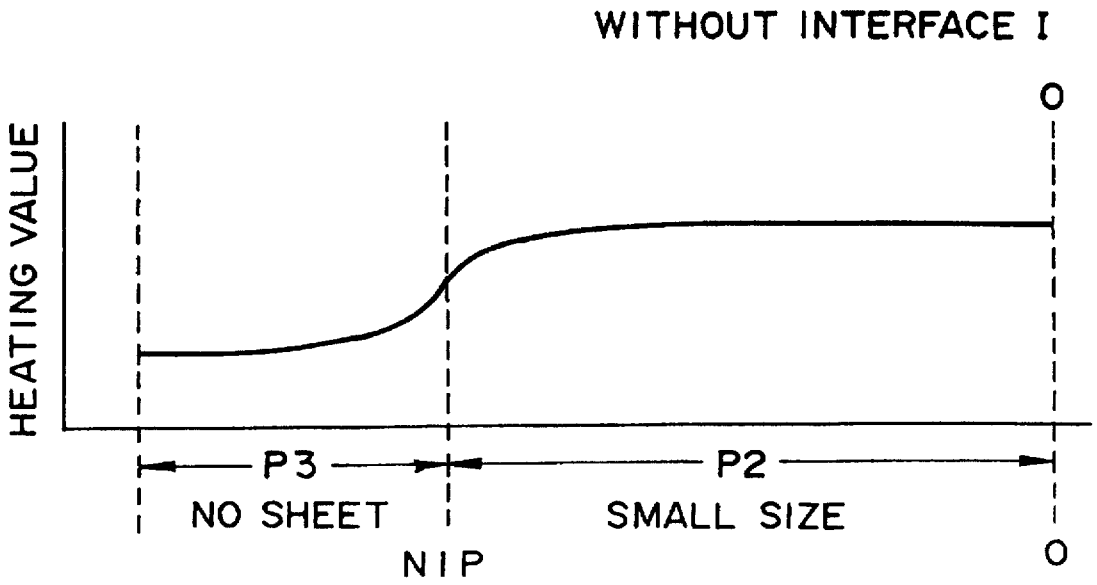
FIG. 4, (*a*) is a graph of amount of heat generation in a longitudinal direction of a nip (heat generating area) when the core metal does not have an interface, and (*b*) is a graph of an amount of heat generation in a longitudinal direction of a nip when the core metal has an interface.
Figure 4B:
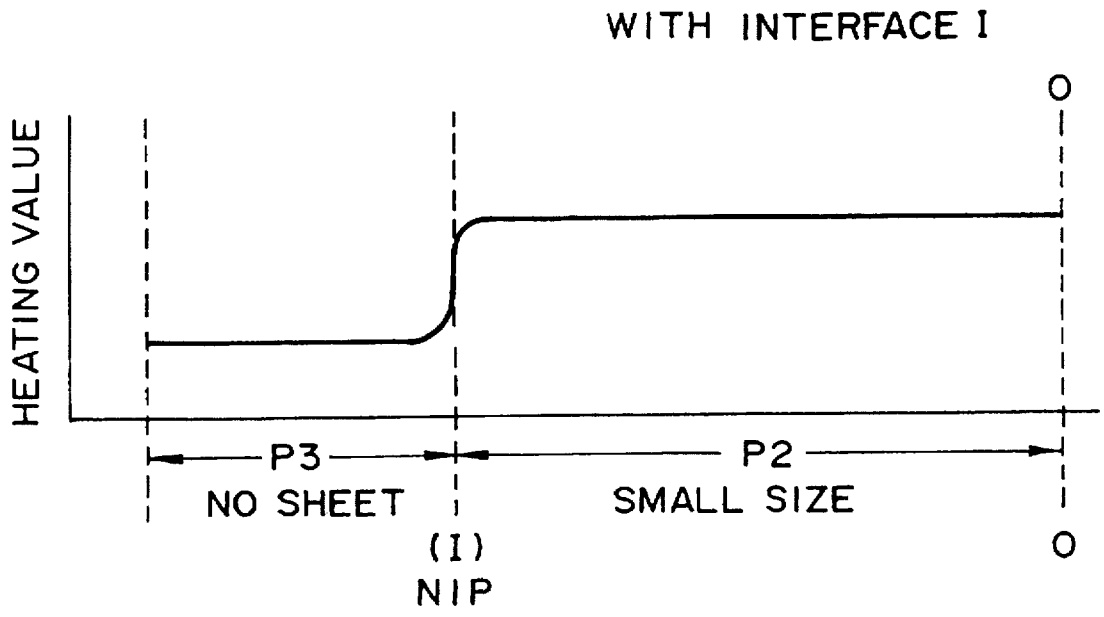

(3) Magnetic field generating means 2 and 3 and core metal 2 (FIGS. 2–4)

The core metal (iron core) 2 of the magnetic field generating means 2 or 3 in this embodiment, as shown in FIGS. 2 and 3, is divided into first and second core members 2a and 2b in a direction crossing with (perpendicular to) of the feeding direction of the film 4 and recording material (member to be heated) P feeding direction. Between the divided core members 2a and 2b, outer surfaces I contacted to each other are provided.

The recording material P is fed along a one side reference line O—O, in this embodiment. Designated by P1 and P2 are sheet passing ranges of a large width recording material and a small width recording material. P3 is a non-passage range when the small size sheet is used. The interface I between the divided core members 2a and 2b, is located substantially corresponding to a sheet end of a small size sheet opposite from the reference line O—O.

By the provision of the interface I between the divided core members 2a and 2b, the thermal conductance between the core members 2a and 2b is worse as compared with the case of no interface I (without division). Therefore, the heat conductance becomes worse from the non-passage range P3 corresponding to the second core metal 2b to the sheet passage range P2 corresponding to the first divided core metal 2a.

The material of the core members 2a and 2b, is ferrimagnetic material, and therefore, the spontaneous magnetization of the second core member 2b decreases with increase of the temperature with the result of the reduction of the magnetic flux H produced by the core metal 2b.

Therefore, the eddy currents induced in the conductive layer 4b reduced with the result of reduction of the heat generation. That is, without the interface I, the heat in the non-passage range P3 in FIG. 4, (*a*), easily transmits to the sheet passage range P2 for the short size sheet, with the result of the temperature rise of the core metal opposite from the reference line O—O in the sheet passage range P3. This results in the reduction of the heat generation in the area opposite from the reference line O—O, and therefore, the improper image fixing is brought about in the area opposite from the reference line in the case of small size sheet processed.

With the provision of the interface I, the heat conductivity at the interface I is low, the heat isolation effect is provided. As shown in FIG. 4, (*b*), the reduction of the heat generation in the area opposite from the reference line in the small size sheet passage region P2, can be prevented. Thus, by the provision of the interface I between the core metals 2*a* and 2*b*, the influence of the temperature rise in the non-passage range P3 due to the temperature rise caused by non-existence of the sheet, is not given to the sheet-passage range P2, thus making uniform the amount of heat generation in the sheet passage area P2 for the small size sheet.

Figure 5:
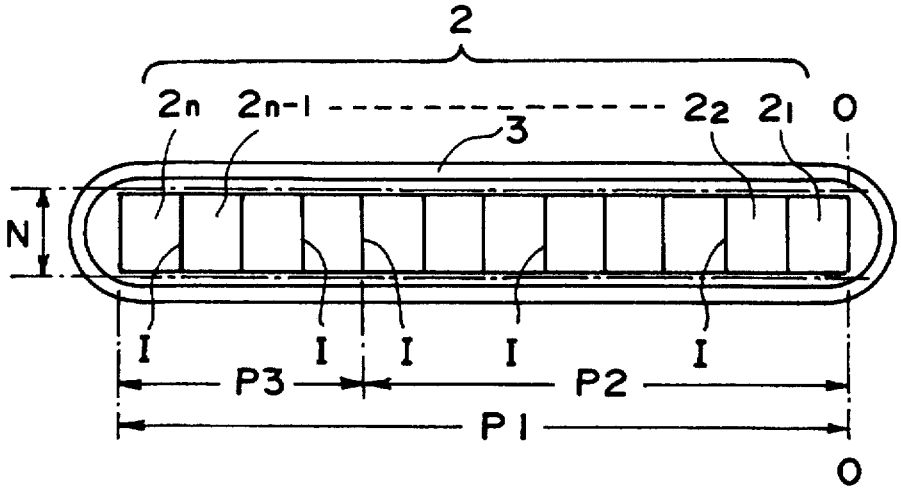
FIG. 5 is a schematic top plan view of an excitation coil and a core member in another embodiment.

As shown in FIG. 5, the core metal 2 may be divided into three or more parts 2*l*–2*n*.

In FIG. 5, the divided core members 2*l*–2*n* have substantially the same size, but the size and/or configuration may be different corresponding to the intended use.

In this embodiment, the reference for the sheet passage is disposed at one lateral edge, but the reference may be on the center of the lateral width. In brief, the interface, or interfaces I may be provided corresponding to the sheet edge of a small size, and therefore, the number or position or positions of the interface or interfaces I are not limited.

Figure 6:
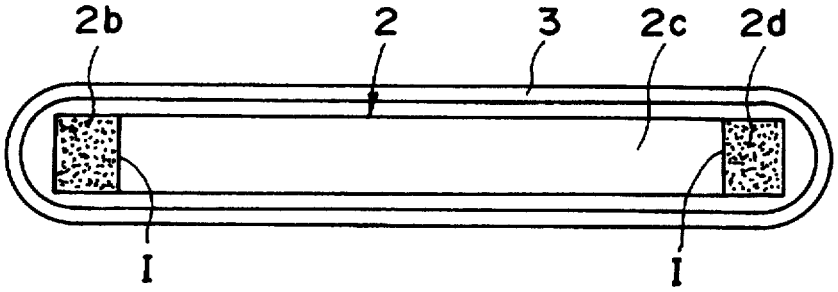
FIG. 6 is a top plan view of an exciting coil and a core member in an apparatus according to Embodiment 2 of the present invention.
Figure 7:
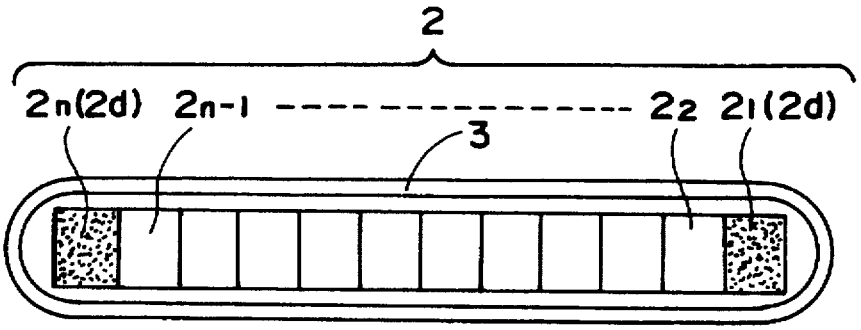
FIG. 7 is a schematic top plan view of an excitation coil and a core metal according to another example.

Embodiment 2 (FIGS. 6 and 7)

FIGS. 6 and 7 are top plan views of a coil and a core member according to Embodiment 2 of the present invention.

In this embodiment, in order to compensate for the heat irradiation at the longitudinal end of the nip (heat generating region), the heat generating amount at the end portions is increased. In order to accomplish this, the materials at the end portions 2*d* and 2*d* at the second portion of the core metal, is different from the material of the rest portion (first portion, core metal 2*c*), and they are the ones capable of producing higher magnetic flux density H. In other words, the magnetic flux density is higher in the core metal 2*d* than in the core metal 2*c*. By doing so, the heat radiation from the end portions can be compensated for to provide uniform temperature distribution over the entire sheet passage region. The structures of the other parts are the same as in Embodiment 1.

Similar to FIG. 5, the structure of FIG. 6 may be such that the core metal is divided into a plurality of parts 2*l*–2*n*.

In FIG. 7, the core metal 2 is constituted by the same size and shape core members 2*l*–2*n*, but it may be constituted by different size and/or shape core members.

In this embodiment, the material of the core metal is partly changed to compensate for the amount of heat, the material of the core metal may be partially changed in order to positively change the temperature distribution, or the core metal may be constituted by three or more materials.

As for the material of the core metal, iron, ferrite, permalloy or the like are preferably used, but the material is not limited if it is capable of producing the magnetic flux H. Additionally, the shapes of the individual core metals are not limited.

Figure 8:
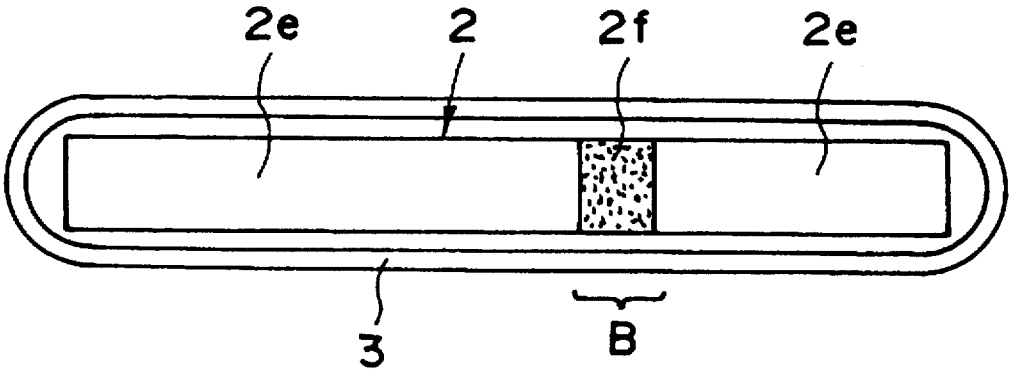
FIG. 8 is a schematic top plan view of an excitation coil and a core metal in an apparatus according to Embodiment 3 of the present invention.
Figure 9:
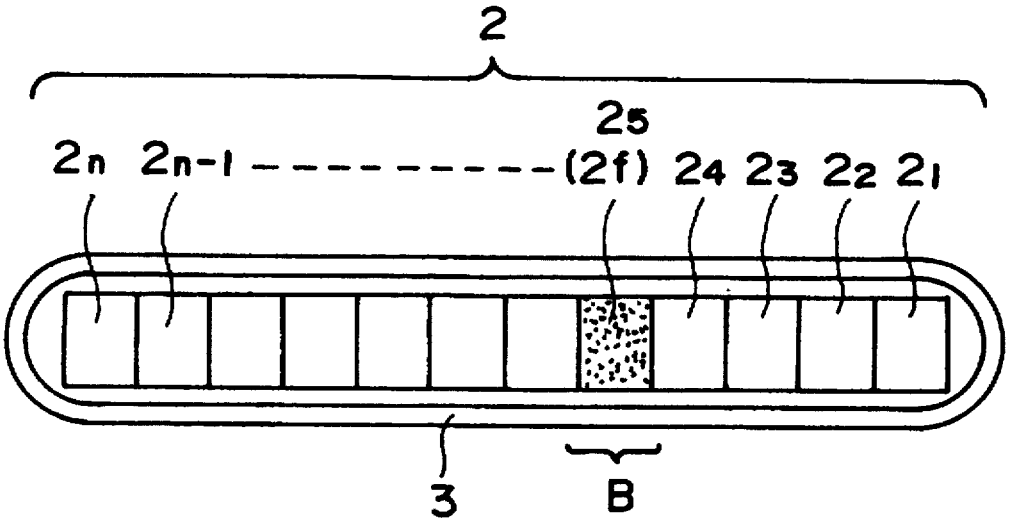
FIG. 9 is a schematic top plan view of an excitation coil and a core metal according to another example.

Embodiment 3 (FIGS. 8 and 9)

FIGS. 8 and 9 are top plan views of a coil and a core metal.

In this embodiment, when a part having a large thermal capacity such as temperature fuse, thermoswitch or the like is contacted to a portion adjacent the nip, the heat is removed to such a part, but the removed heat energy is compensated. To accomplish this, as shown in FIG. 8, a second core metal portion 2*f* corresponding to the position where the part is contacted, is so constructed as to produce a larger magnetic flux H than the other portion of the core metal 2*e* (first portion).

By doing so, the amount of the heat escaping to the part is compensated for so that the uniform temperature distribution can be provided over the entirety of the sheet passage region.

The other structure of the apparatus is the same as in Embodiment 1.

Similarly to FIG. 5, the core metal 2 of FIG. 8 may be divided into a plurality of parts 2*l*– 2*n*, as shown in FIG. 9.

In FIG. 9, the divided core metals 2*l*–2*n* have the same sizes and the same configurations, but they may have different sizes of configurations.

In this embodiment, the magnetic of the core metal is changed to compensate for the shortage of the amount of the heat, but the material of the core metal may be changed to positively change the temperature distribution, and the core metal may be made of three or more materials. As for the material of the core metal, iron, ferrite, permalloy or the like are preferably usable, but another material is usable if the magnetic flux H can be produced. The configurations of the individual core metals are not limited.

Figure 10:
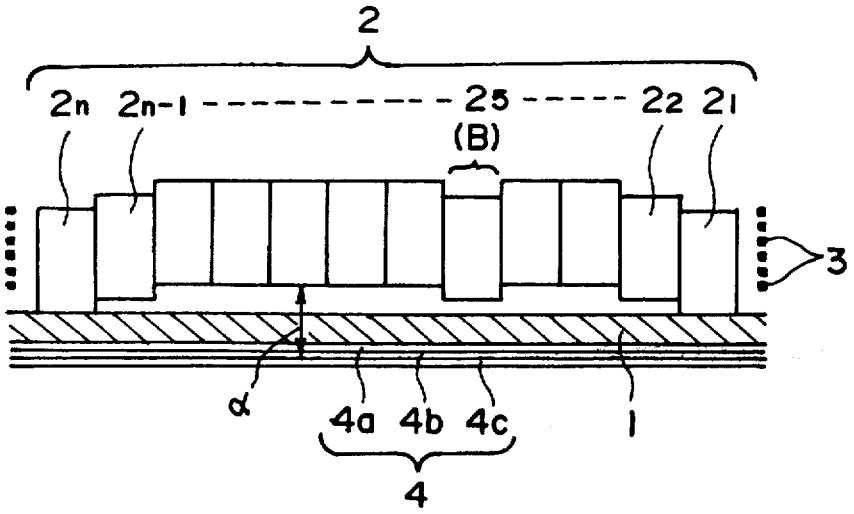
FIG. 10 is a schematic side view of an arrangement of core members in an apparatus according to Embodiment 4.

Embodiment 4 (FIG. 10)

FIG. 10 is a side view of a core metal used in this embodiment.

In this embodiment, the structures are the same as in Embodiment 1, except for the configuration and arrangement of the core metal.

The distance a between the core metal 2 of the magnetic field generating means 2 and 3 and the electroconductive layer 4*b* of the film is such that the magnetic flux density per unit area of the electroconductive layer 4*b* increases with decrease of the difference, and therefore, the magnetic flux density decreases with increase of the distance. Therefore, by adjusting the distance between the magnetic flux 2 and the conductive layer 4*b*, the eddy current induced can be induced, thus permitting adjustment of the amount of the heat generation.

According to this embodiment, the heat radiation at the end portions of the nip N is compensated for, and in addition, the heat escape to a large thermal capacity part such as temperature fuse or thermostat or the like contacted to the neighborhood of the nip. To accomplish this, as shown in FIG. 10, the core metal 2 is divided into a plurality of portions 2*l*–2*n* in the longitudinal direction, and in addition, the distances, from the conductive layer 4*b* of the film 4, the end core metals 2*l* and 2*n* and the core member 25 corresponding to the contact portion B, are made smaller than that for the other core members. By doing so, the uniform heat generating distribution can be provided over the entire longitudinal length of the nip. The distance a between the conductive layer and the core metal is adjusted in the range 0.001 mm–10 mm.

In this embodiment, the core member 2 is constituted by the same size and same configuration sub-core members 2*l*–2*n*, but the sub-core-members may have different sizes and/or configurations. In this embodiment, the material of the sub-core-members are the same, but different materials are usable for them.

This embodiment is intended for compensate for the shortage of the amount of heat, but this embodiment is usable for positively changing the temperature distribution. Two or more materials are usable for the core member. The material of the core member is preferably iron, ferrite, permalloy or the like, but may be another material if it is capable of producing magnetic flux H. The configurations of the individual core members are not limited.

Figure 11:
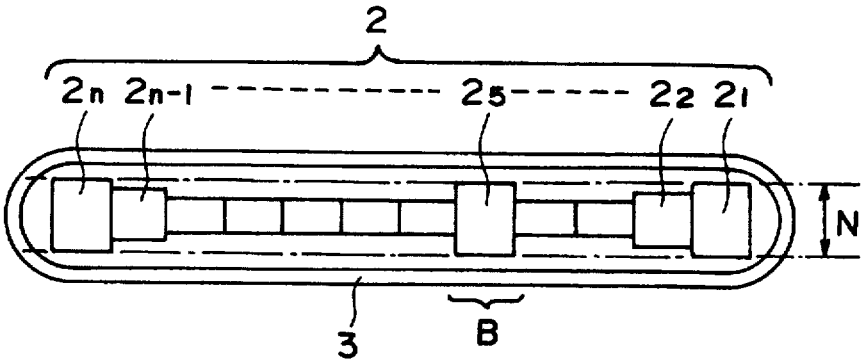
FIG. 11 is a schematic top plan view of an excitation coil and a core metal in Embodiment 5 of the present invention.

Embodiment 5 (FIG. 11)

FIG. 11 is a top plan view of a coil and a core member according to Embodiment 5.

The magnetic flux produced by the same excitation coil 3 increases with increase of the cross-sectional area of the core metal.

In this embodiment, therefore, as shown in FIG. 11, the core member 2 is divided into a plurality of parts 2*l*–2*n*, and in addition, the cross-sectional area of the core metal is made larger in the end core members 2*l*–2*n* and in the core member 25 corresponding to the large thermal capacity part contact portion B. In other words, the width of the core member measured in the film movement direction is larger in the end and B portions than in the other portions. The other structures are the same as in Embodiment 1.

By doing so, the end heat radiation of the nip can be compensated for, and in addition, the heat escape at the large thermal capacity part contacted portion, can also be compensate for, so that the same advantageous effects as in Embodiment 4, can be accomplished.

This embodiment is intended for compensating for the shortage of the heat, but it may be used for positively changing the temperature distribution. Two or materials are usable for constituting the core member. The material of the core metal is preferably iron, ferrite, permalloy or the like, but another material is usable if it is capable of producing magnetic flux H. The configurations of the individual core metals are not limited.

As for another method for adjusting the magnetic flux H, the direction of the core metal relative to the conductive layer may be changed. Therefore, the configuration, material, arrangement (including direction) are not limited to those described above.

Figure 12:
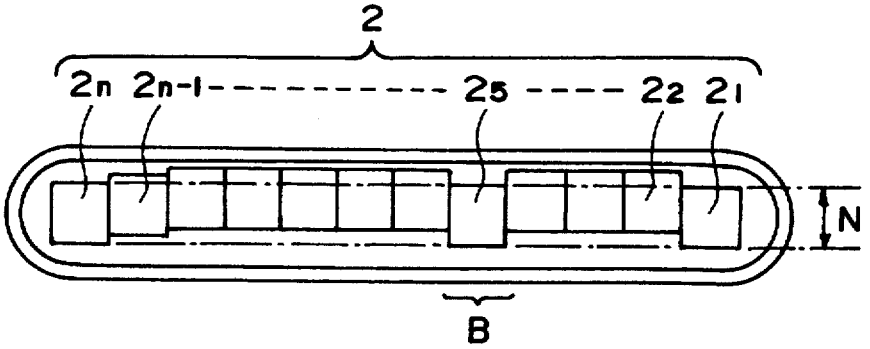
FIG. 12 is a schematic top plan view of an excitation coil and a core member in an apparatus according to Embodiment 6.

Embodiment 6 (FIG. 12)

FIG. 12 is a top plan view of a coil and a core metal according to Embodiment 6.

The amount of the heat generation in the nip can be changed by changing an area of the core metal 2 overlapping with the nip N.

In view of this, in this embodiment, as shown in FIG. 12, the core metal 2 is divided into a plurality of parts 2*l*–2*n* in the longitudinal direction, and the overlapping area is increased in the first portion including the end portion (core members 2*l* and 2*n*) the core member 25 corresponding to the large capacity part contacting portion than in the first portion which is the rest of the divided core members. More particularly, the position of the second core member in the film movement direction is more inside the nip as compared with the first core member.

The individual divided core members 2*l*–2*n* has the same configuration and of the same materials. The other structures are the same as in Embodiment 1.

By doing so, the amount of heat generation applied to the nip N can be changed for the respective core members, although the magnetic flux densities are the same. Thus, the same advantageous effects as in Embodiment 5, can be provided.

The structure of this embodiment is to compensate for the shortage of the amount of heat, but this embodiment is usable to positively change the temperature distribution. Two or more materials may be used for the core member or members. The material of the core member is preferably iron, ferrite, permalloy or the like, but another material is usable if it is capable of producing magnetic flux H. The configurations of the individual core members are not limited. As for the method for adjusting the magnetic flux density H, the direction of the core member relative to the conductive layer 4*b* can be changed. Therefore, the configurations, materials, arrangement (including direction) are not limited.

In the foregoing Embodiments 1–6, the direction of the magnetic field is incident perpendicularly on the film 4, but the magnetic field may be applied from an external coil in a direction parallel with the layer surface into the electroconductive layer 4*b*.

If the use is made for the material constituting the electroconductive layer 4*b* with the material having a Curie temperature which is the temperature required for the fixing, the specific heat increases when the temperature reaches the Curie temperature, and therefore, the self temperature control is accomplished. When the temperature exceeds the Curie temperature, the spontaneous magnetization disappears, by which the magnetic field formed in the conductive layer 4*b* decreases as compared with the case of the temperature lower than the Curie temperature, and therefore the eddy current decreases to suppress the heat generation, and therefore, the self temperature control is accomplished. The Curie temperature point is preferably 100°–200° C. to much the softening point of the toner.

Around the Curie temperature, the resultant inductance Of the excitation coil 3 and the film 4 changes significantly, and therefore, it is a possible alternative that the temperature is detected at the excitation circuit side for applying the high frequency to the coil 3, and on the basis of the detected temperature the temperature control is carried out.

As for the material of the core metal 2 of the coil 3, it is preferable that it has a low Curie point.

When the recording material feeding operation stops with the result of incapability of the temperature control, the temperature of the core metal 2 starts to rise. As a result, as seen from the circuit for producing the high frequency, it is as if the inductance of the excitation coil 3 is increased. Therefore, the excitation circuit controls to match with the frequency, in other words, increases the frequency with the result that the energy is consumed as electric energy loss of the excitation circuit, so that the energy supplied to the coil 3 reduces. Thus, the uncontrollable situation can be prevented. More particularly, the Curie point is preferably 100°–250° C.

Below 100° C., it is lower than the fusing or melting point of the toner, and therefore, even if the inside of the film is insulated, the temperature rise occurs with the result that the erroneous operation tends to occur in the uncontrollable operation prevention. If it is higher than 250° C., the uncontrollable operation can not be prevented. In the foregoing, the film heating is taken as an example, but it applies to a heat roller having a core member of low thermal conductivity.

However, the thin film heating type using low thermal conductivity base member is preferably since the high magnetic flux density can be provided when the distance between the excitation coil and the conductive layer is small.

Figure 13A:
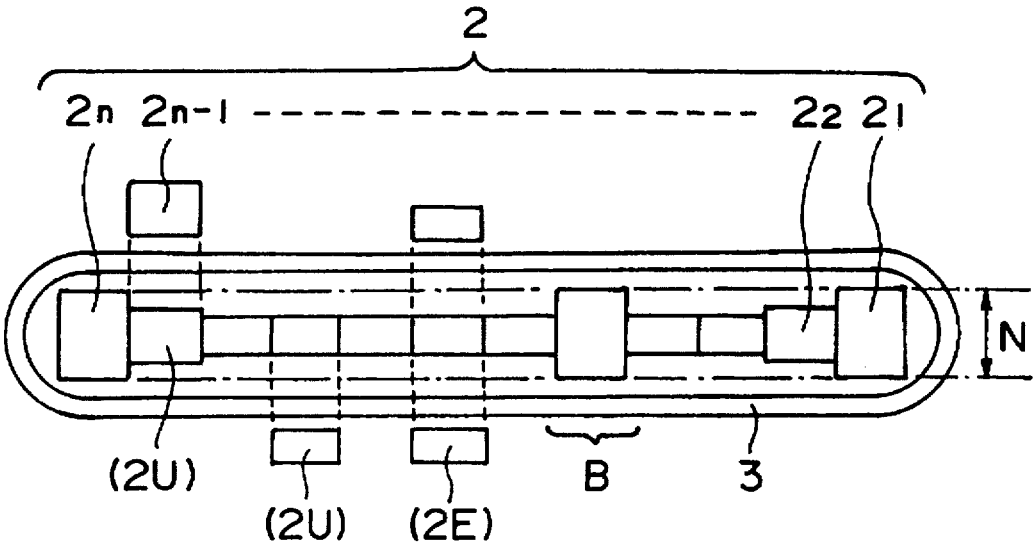
FIG. 13, (*a*) is a schematic top plan view of an excitation coil and a core member in an apparatus according to Embodiment 7, (b*), illustrates U-shaped core member, and* (*c*) illustrates E-shaped core member.
Figure 13B:
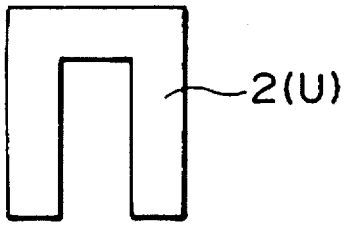
Figure 13C:
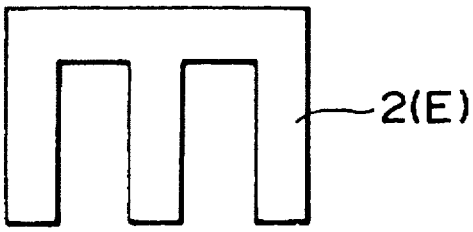

Embodiment 7 (FIG. 13)

FIG. 13, (a) is a top plan view of a coil and a core metal.

In the foregoing Embodiments 1–6, the core metal 2 has an "I" configuration, but it may be "U" or "E" core metal. They may be combined, and the same configuration is usable with different dimension or material. FIG. 13 shows such an example, (B), shows an example of a core member 2 having, in combination, U-type core member 2, E-type core member 2 as shown in (c), and I-type core member 2. In the case of U- or E-type core member, the coil is sandwiched by the core metals.

In this embodiment, the U-type core member 2 and the E-type core member 2 are arranged as shown in FIG. 13, (*a*), relative to the nip N, but the amount of heat generation in the nip is changeable by shifting the U-type core member 2 or E-type core member 2 in the nip in the sheet feeding direction. Embodiment 8 (FIG. 14)

Figure 14A:
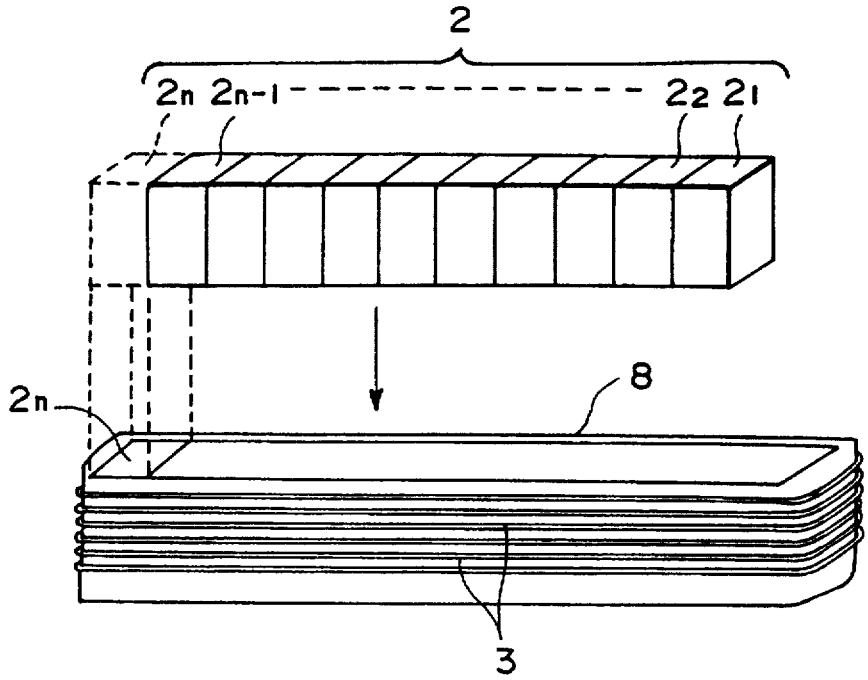
FIG. 14, (*a*), and (*b*), are exploded perspective views of magnetic field generating means of an apparatus according to Embodiment 8.
Figure 14B:
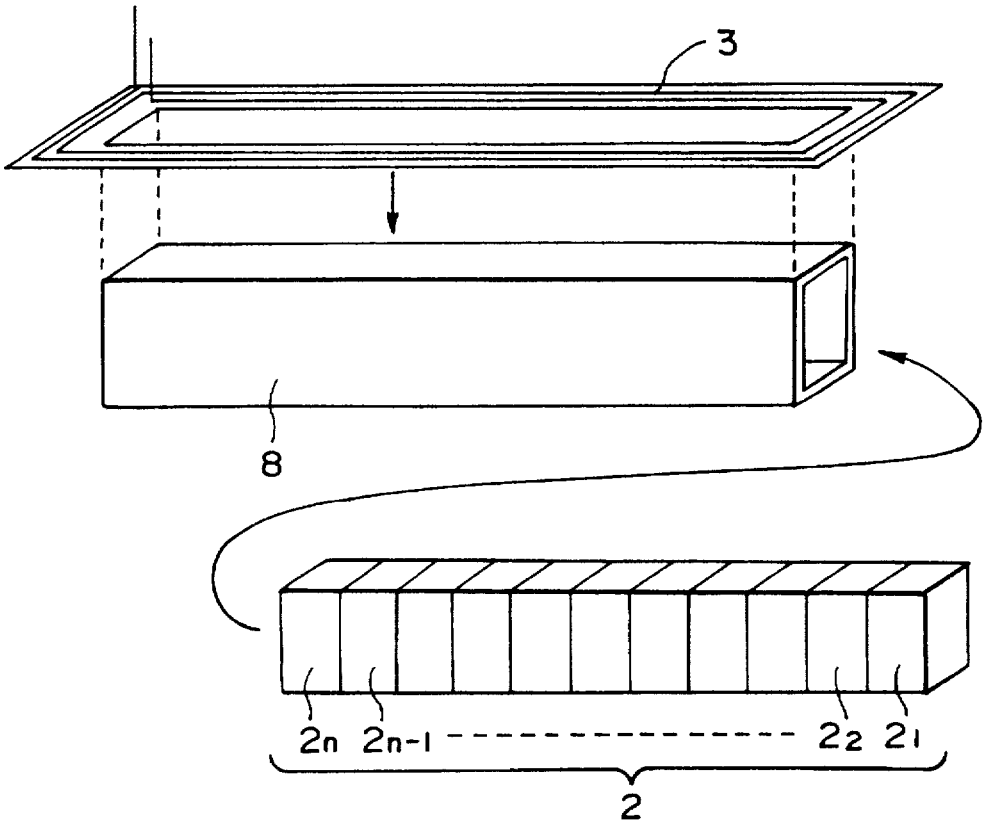

FIG. 14 shows Embodiment 8 of the present invention.

In this embodiment, division type core members 2 (2*l*–2*n*) are inserted into a holder 8 to accomplish the positioning of the core members 2*l*–2*n*. In Example, (a) of FIG. 14, the upper part is open, and the division type core members 2*l*–2*n* are let fall in the holder 8 wound by an excitation coil 3. In example (b), the division type core members 2*l*–2*n* are inserted into a square cylindrical holder 8 through an end opening, and it is covered by a sheet like excitation coil 3 produced by forming a coil on a sheet coil surface with sputtering with Ag, Pt or another conductive member through screen printing, CVD, sputtering or the like.

The stay 1 in FIG. 1 is usable as a holder for the core member.

Figure 15:
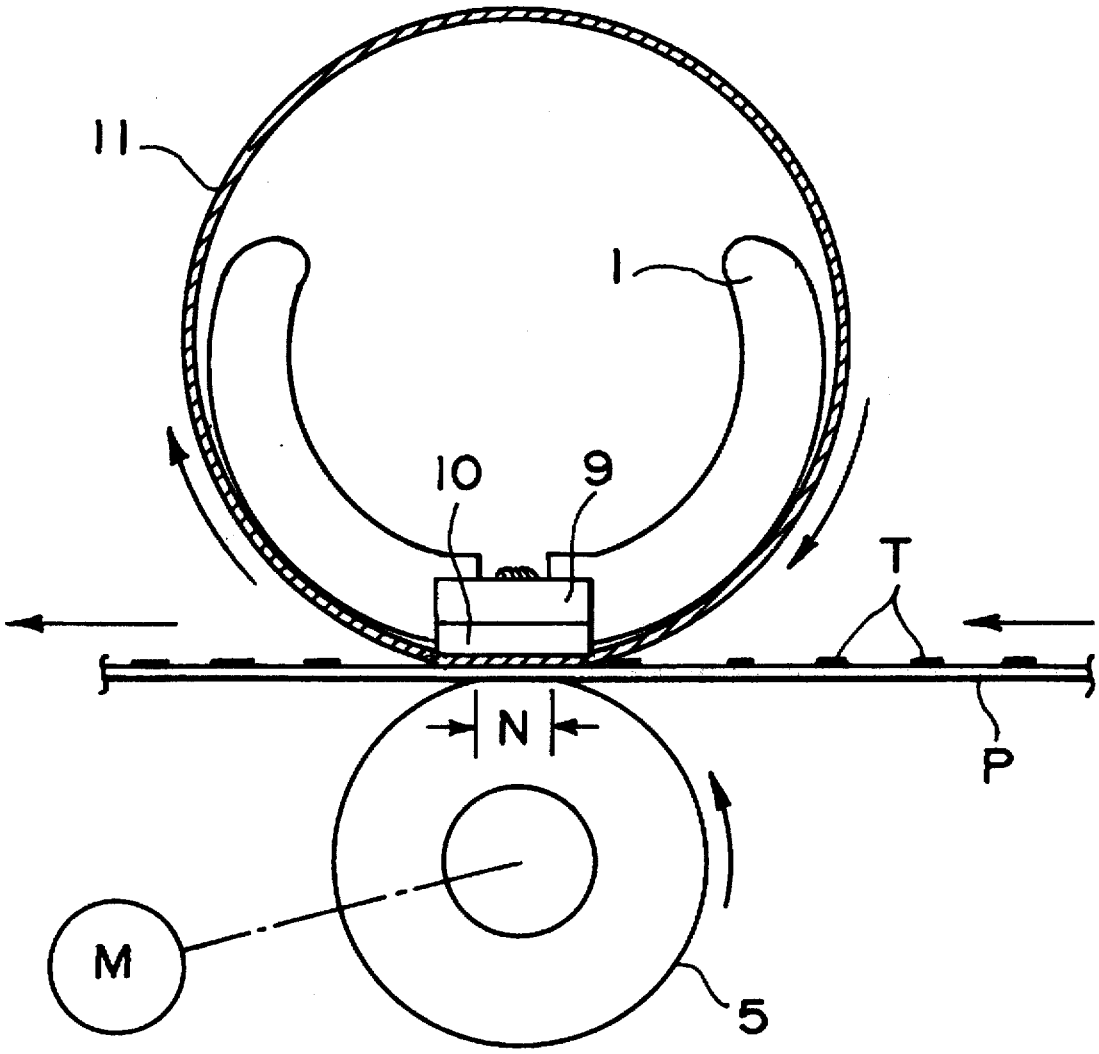
FIG. 15 is a schematic view of a heating apparatus according to a further embodiment.

In the foregoing embodiments, the film produces the heat, but the present invention is applicable to the apparatus shown in FIG. 15.

In this embodiment, the magnetic field generating means is electromagnetic induction heater assembly comprising a field coil plate 9 faced or contacted to each other and magnetic metal 10 as the induction magnetic material. The assemblies 9 and 10 is mounted along the length substantially at the center of the bottom surface of the film inside guide stay 1 having substantially semi-circular cross-section and having sufficient rigidity and heat resistant property made of heat curing resin or the like, while the magnetic metal 10 is faced down.

Designated by reference 11 is an endless heat resistive film, and is loosely extended around the film inside guide stay 1 including the electromagnetic induction heater assemblies 9 and 10, and the film 11 is press-contacted to the bottom surface of the magnetic metal 10 of the electromagnetic induction heater assembly 9 and 10 by a pressing roller. The film 11 may be provided with an electroconductive layer.

The pressing roller 5 is rotated in the indicated counterclockwise direction by driving means M, so that the film 11 receives rotational driving force by the friction between the roller and the film outside surface and the rotation of the pressing roller, and therefore, the film 11 moves sliding on the bottom surface of the magnetic metal member 10.

The high frequency magnetic field produced by the magnetic field coil of the field coil plate 9 is magnetically combined with the magnetic metal member 10, and the eddy current loss produced by the magnetic field generates heat in the magnetic metal member 10. By the heat generation of the metal member 10, the heat resistive film 11 is heated by the contact with the magnetic metal member 10.

The recording material 6 to be subjected to the image fixing operation is introduced between the pressing roller 5 and the film 11 at the nip formed by the pressing roller 5 and the magnetic metal member 10 with the film 11 therebetween. The recording material is fed together with the film 11 through the nip, so that the heat of the magnetic metal 10 is applied to the recording material P through the film 11, so that the unfixed toner image T is fixed on the surface of the recording material P. The recording material P having passed through the nip N is separated from the surface of the film 11, as shown in the Figure.

In such an apparatus, the magnetic metal member 10 may be divided in the longitudinal direction, or the material thereof may be partly changed so that the same advantageous effects as in Embodiments 1–6 can be provided.

Figure 16B:
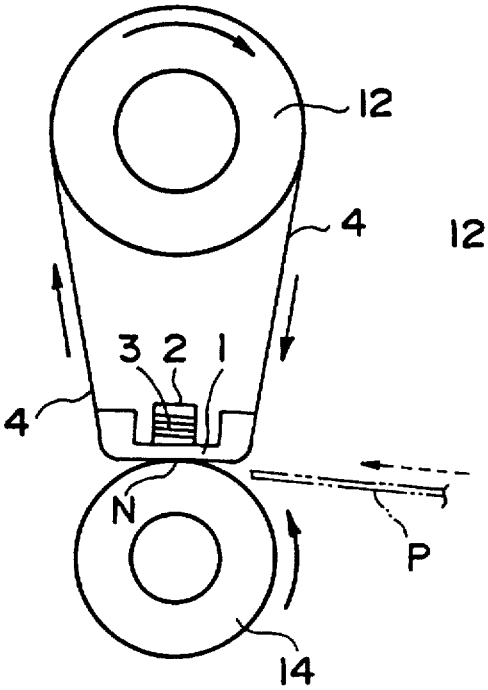
FIG. 16, (*a*), (*b*), and (*c*) are schematic views of heating apparatuses according to further embodiments.
Figure 16A:
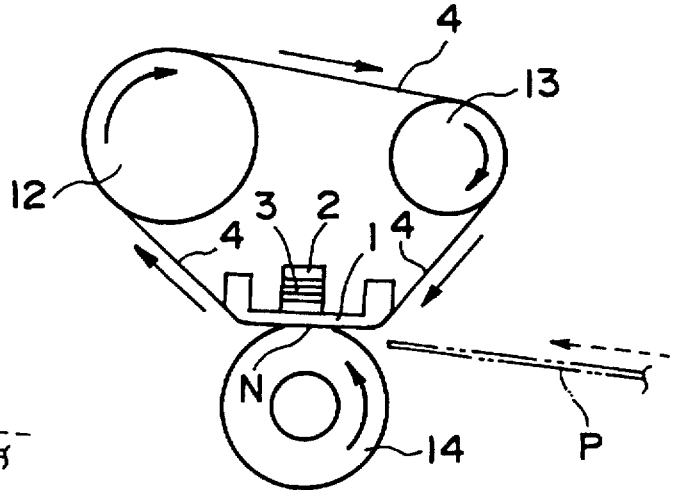
Figure 16C:
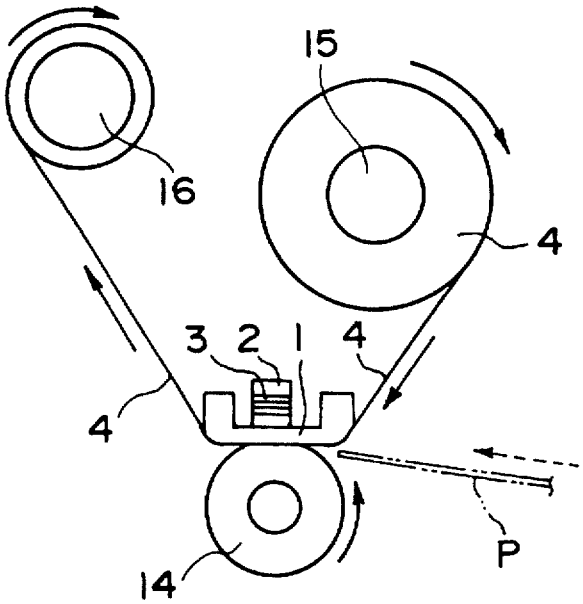

FIGS. 16, (*a*), (*b*) and (*c*) show other examples of the heating apparatus of electromagnetic induction heating type to which the present invention is applicable.

In FIG. 16, (*a*), a film 4 as the endless belt conductive member is extended around the three members, namely, the bottom surface of the stay 1 of the heater assemblies 1, 2 and 3, the driving roller 12 and the follower roller (tension roller) 13, in which the film 6 is driven by a driving roller 12. A pressing roller 14 is press-contacted to the bottom surface of the stay with the film 4 therebetween, and is rotated by the rotating film 4.

In FIG. 16, (*b*), the film 4 as the endless belt conductive member, is extended around two members, the bottom surface of the stay 1 for the heater assemblies 1, 2 and 3 and the driving roller 12, and the film is driven by the driving roller 12.

In FIG. 16, (*c*), the film 4 (conductive member) is not an endless belt, but a rolled long non-endless film. This is supplied out from a supply shaft 15, and extended below the bottom surface of the stay for the heater assemblies 1, 2 and 3, and is taken up by a take-up wheel 16 at a predetermined speed.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

magnetic flux generating means, having an excitation coil and a core member therein, for generating magnetic flux;

an electroconductive member, movable together with a recording material having and image, for generating heat by eddy current generated therein by the magnetic flux generated by said magnetic flux generating means, wherein the image is heated by the heat;

wherein said core member is divided into first and second portions in a direction substantially perpendicular to a movement direction of said electroconductive member.

2. An apparatus according to claim 1, wherein an interface where said first and second portions are contacted, corresponds to a boundary between a recording material passage region and a non-passage region.

3. An apparatus according to claim 1, wherein said core member is accommodated in a holder.

4. An apparatus according to claim 1, wherein said electroconductive member is a film having an electroconductive layer.

5. An apparatus according to claim 4, wherein said film is an endless film.

6. An apparatus according to claim 1, further comprising a pressing member cooperative with said electroconductive member to form a nip therebetween.

7. An apparatus according to claim 6, wherein said pressing member includes a rotatable member for driving said electroconductive member.

8. An image heating apparatus comprising:

magnetic flux generating means, having an excitation coil and a core member therein, for generating magnetic flux;

an electroconductive member, movable together with a recording material having and image, for generating heat by eddy current generated therein by the magnetic flux generated by said magnetic flux generating means, wherein the image is heated by the heat;

wherein said core member has first and second portions comprising materials different from each other and existing at different positions in a direction substantially perpendicular to a movement direction of said electroconductive member.

9. An apparatus according to claim 8, wherein a magnetic flux density is larger in said second portion than in said first portion.

10. An apparatus according to claim 9, wherein the material of said second portion is iron, ferrite or permalloy.

11. An apparatus according to claim 9, wherein said second portion corresponds to an end of said core member.

12. An apparatus according to claim 9, further comprising a temperature sensor for sensing a temperature of said image heating apparatus, wherein said second portion is disposed at a position corresponding to said temperature sensor in the perpendicular direction.

13. An apparatus according to claim 8, wherein said first and second portions are divided from each other.

14. An image heating apparatus comprising:

magnetic flux generating means, having an excitation coil and a core member therein, for generating magnetic flux;

an electroconductive member, movable together with a recording material having and image, for generating heat by eddy current generated therein by the magnetic flux generated by said magnetic flux generating means, wherein the image is heated by the heat;

wherein said core member has first and second portions differently distant away from said electroconductive member and existing at different positions in a direction substantially perpendicular to a movement direction of said electroconductive member.

15. An apparatus according to claim 14, wherein a magnetic flux density is larger in said second portion than in said first portion.

16. An apparatus according to claim 15, wherein said second portion corresponds to an end of said core member.

17. An apparatus according to claim 15, further comprising a temperature sensor for sensing a temperature of said image heating apparatus, wherein said second portion is disposed at a position corresponding to said temperature sensor in the perpendicular direction.

18. An apparatus according to claim 14, wherein the distance between said core member and said electroconductive member is 0.001–10 mm.

19. An apparatus according to claim 14, wherein said first and second portions are divided from each other.

20. An image heating apparatus comprising:

magnetic flux generating means, having an excitation coil and a core member therein, for generating magnetic flux;

an electroconductive member, movable together with a recording material having and image, for generating heat by eddy current generated therein by the magnetic flux generated by said magnetic flux generating means, wherein the image is heated by the heat;

wherein said core member has first and second portions having different widths measured in a direction of movement of said electroconductive member and existing at different positions in a direction substantially perpendicular to a movement direction of said electroconductive member.

21. An apparatus according to claim 20, wherein an amount of the magnetic flux is larger in said second portion than in said first portion.

22. An apparatus according to claim 21, wherein said core member sandwiches said excitation coil in said second portion.

23. An apparatus according to claim 21, wherein said second portion corresponds to an end of said core member.

24. An apparatus according to claim 21, further comprising a temperature sensor for sensing a temperature of said image heating apparatus, wherein said second portion is disposed at a position corresponding to said temperature sensor in the perpendicular direction.

25. An apparatus according to claim 20, wherein said first and second portions are divided from each other.

26. An image heating apparatus comprising:

magnetic flux generating means, having an excitation coil and a core member therein, for generating magnetic flux;

an electroconductive member, movable together with a recording material having and image, for generating heat by eddy current generated therein by the magnetic flux generated by said magnetic flux generating means, wherein the image is heated by the heat;

wherein said core member has first and second portions at different positions in a direction of movement of said electroconductive member and existing at different positions in a direction substantially perpendicular to the movement direction of said electroconductive member.

27. An apparatus according to claim 26, further comprising a pressing member cooperative with said electroconductive member to form a nip, wherein an amount of magnetic flux passing through the nip corresponding to said second portion is larger than that of the magnetic flux passing through the nip corresponding to said first portion.

28. An apparatus according to claim 27, wherein said second portion corresponds to an end of said core member.

29. An apparatus according to claim 27, further comprising a temperature sensor for sensing a temperature of said image heating apparatus, wherein said second portion is disposed at a position corresponding to said temperature sensor in the perpendicular direction.

30. An apparatus according to claim 26, wherein said first and second portions are divided from each other.

* * * * *